United States Patent [19]

Skahill

[11] 4,290,339

[45] Sep. 22, 1981

[54] CAM ACTUATED AMMUNITION PRESTRIPPING MECHANISM

[75] Inventor: Fred J. Skahill, Davenport, Iowa

[73] Assignee: The United States of America as represented by the Secretary of the Army, Washington, D.C.

[21] Appl. No.: 62,085

[22] Filed: Jul. 30, 1979

[51] Int. Cl.[3] ..... F41D 10/06

[52] U.S. Cl. ..... 89/33 CA

[58] Field of Search ..... 89/33 BB, 33 BC, 33 C, 89/33 CA

[56] References Cited

U.S. PATENT DOCUMENTS

| | | | |
|---|---|---|---|
| 2,383,830 | 8/1945 | Trotter et al. | 89/33 BC |
| 3,000,265 | 9/1961 | Robinson | 89/33 C |
| 4,061,074 | 12/1977 | Johnson et al. | 89/33 CA |

FOREIGN PATENT DOCUMENTS

| | | | |
|---|---|---|---|
| 584268 | 1/1947 | United Kingdom | 89/33 CA |

*Primary Examiner*—Stephen C. Bentley

*Attorney, Agent, or Firm*—Nathan Edelberg; Robert P. Gibson; A. Victor Erkkila

[57] ABSTRACT

Apparatus for initiating the removal or stripping of a round of ammunition from an ammunition link belt for feeding automatic weapons comprising a cam situated proximate to and rearwardly from the feed means of an automatic weapon, the cam having a surface inclining upwardly in the direction of feed so as to impart a positive forward displacement of the round to disengage the round from a link retention tab prior to the counter recoil stroke of the operating group of the automatic weapon, thereby permitting the operating group to engage the base of the round and move the round into battery with significantly reduced energy requirements.

3 Claims, 4 Drawing Figures

CAM ACTUATED AMMUNITION PRESTRIPPING MECHANISM

GOVERNMENT RIGHTS

The invention described herein may be manufactured, and/or used by or for the Government for Governmental purposes without the payment of any royalties thereon.

BACKGROUND OF THE INVENTION

The present invention relates to automatic weapons of the type wherein the ammunition is fed automatically into the weapon, the ammunition being contained in or mounted in a metallic link, which link and ammunition cooperate to form a belt of ammunition, such that the removal of the round from the link belt permits the ammunition links to be disengaged and automatically discarded from the weapon. In this type of ammunition belt, the ammunition round and the links cooperate so as to form a chain wherein the round acts as the pintle of a hinge pivotally connecting adjacent links.

Weapons of the type to which the invention herein is directed, are exemplified by the M-60 machine gun, the XM 235 Squad Automatic Weapon and the M-85 machine gun. These weapons are characterized by ammunition contained in belts of approximately 100 rounds each. The design conserves weight and permits the assembly of the link ammunition with the use of relatively inexpensive metal links which are readily disconnected from the round upon firing and which are of small monetary value and therefore need not be collected after firing.

The links which are utilized to connect the ammunition rounds are of such a shape and character, that they conform closely to the outer diameters of the ammunition rounds and provide a secure means for linking ammunition rounds together. Additionally, the links align the ammunition rounds so that the ammunition belt is of uniform width, i.e. the bases of the linked ammunition define a single plane. This is accomplished by an extended retention tab on each link which seats in an annular indentation near the base of each round.

Before the intentive concept can be thoroughly understood it is necessary to understand the operation of a typical automatic weapon. When ready for firing, the operating group, which contains the firing pin, is in intimate contact with the ammunition round in the chamber. When the trigger is depressed, the firing pin within the operating group contacts the base of the ammunition round thereby causing ignition of powder within the round which results in the expansion of gases and the propulsion of a projectile (e.g. bullet) through the barrel of the weapon and to the target. Energy created by the expanding gases is utilized to cause the operating group to recoil or move rearwardly from the battery position. During the course of such recoil motion, the automatic feed mechanism of the weapon places the next round in position for displacement into the chamber by the operating group. The operating group reaches its rearmost position at which point, it has compressed the drive spring, thereafter, on the counter recoil stroke, moves the operating group forward into contact with the base of the ammunition round, removing the round from the link and into the chamber. The cycle of operation is completed as the operating group again achieves battery position so that the firing pin may make contact with the round, thereby initiating the ignition of powder once again.

The present state of the art requires the operating group to completely strip the ammunition round from the link belt on its counter recoil stroke. The energy for this counter recoil stroke comes totally from the drive spring which aids in absorbing the recoil energy associated with the firing of an ammunition round. The drive spring returns the operating group to its battery position and in the process, strips the round from the link belt. It is recognized by those skilled in the art, that a weapon system capable of fully automatic firing imparts tremendous forces upon the components of the weapon (e.g. drive spring, extractor, sear, buffer, etc.) Therefore, any assistance which can be given to these components or any resistance which can be removed or reduced will have a beneficial effect upon the life of the parts of the system.

SUMMARY OF THE PRESENT INVENTION

The invention which is the subject of this application, serves to reduce the resistance which the drive spring and the operating group must overcome in the counter recoil stroke. Stated differently, the invention of this application reduces the load on the drive spring during the counter recoil stroke by transferring a portion of the stripping energy load from the counter recoil stroke to the recoil stroke where there is an abundance of energy available.

The amount of energy in question is that amount of energy which relates to achievement of a prestripping of an ammunition round from the ammunition link in which it is fed into the weapon. Traditionally, ammunition to be fed is placed just in front of the bolt face of the weapon and, when the trigger is pulled, the bolt moves about one-quarter ($\frac{1}{4}$) of an inch unimpeded to the base of the ammunition whereafter the drive spring displaces the ammunition from the belt link into the weapon chamber. Thus, the drive spring is required to have sufficient stored energy to strip the round from the link or there must be a greater amount of free travel before the bolt engages the ammunition round. The latter is undesirable since the overall length of the weapon would increase.

The resistance to stripping is a function of the relationship of the ammunition link with the ammunition round. The link is in intimate frictional contact with the circumference of the round and contains a retention tab having a notch which conforms to the annular indentation proximate to the bottom of the round. Once the ammunition round is prestripped, i.e. moved relative to the link far enough to displace the retention tab from the annular indentation, the amount of energy required to complete the stripping process is greatly reduced.

The present invention contemplates an initial displacement of the round within the link, i.e. a prestripping, during the recoil stroke so as to utilize the abundant energy available during recoil to effect prestripping, reduce the amount of load experienced by the drive spring during counter recoil and thereby reduce the energy of the gas system which, as will be recognized by those skilled in these arts, adds to overall reliability and life of the weapon.

As is discussed hereinafter in detail, the invention utilizes an inclined plane or cam surface, mounted on the weapon feed tray for example, which engages the bottom of the round during recoil such as to partially displace the round within the link by an amount sufficient to disengage the annular indentation of the round from the retention tab on the link belt, thereby reducing the frictional element which normally would be overcome by the drive spring and the operating group. The amount of energy thus utilized to effect the prestripping is energy which is transferred from the counter recoil stroke to the recoil stroke thereby clearly improving the operation, longevity and efficiency of the weapon. This is achieved by the apparatus according to the present invention, one embodiment of which may include an automatic weapon having means thereon for advancing an ammunition link belt together with rounds of ammunition into firing position and a cam mechanism secured to the weapon, the cam mechanism being mounted on the weapon in the direction of advancement of the rounds toward firing position and of sufficient incline surface to effect engagement of the round during advancement and displacement of the round along its longitudinal axis such as to disengage the round from a link retention tab formed on the ammunition link.

BRIEF DESCRIPTION OF DRAWINGS

A more complete understanding of the present invention may be had from the following detailed description, particularly when read in conjunction with the attached drawings, wherein.

DETAILED DESCRIPTION OF ILLUSTRATIVE EMBODIMENTS

As noted above, this invention is directed to a combination of apparatus for use with automatic firing weapons to prestrip rounds of ammunition within an ammunition link belt so as to reduce the energy requirements of the weapon.

In order to provide a complete understanding of the invention, it is desirable to describe briefly the structure of the ammunition links which cooperate with the ammunition to define an ammunition link.

Figure 1A:
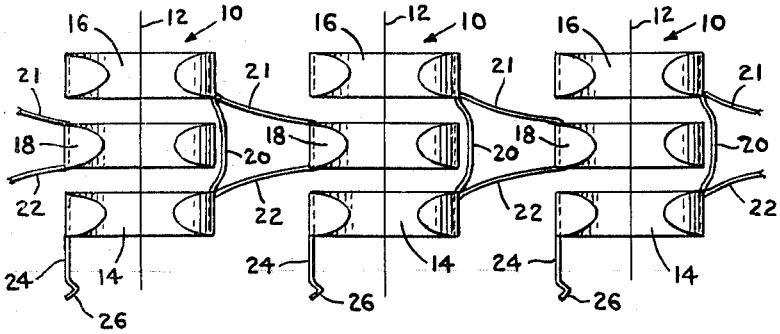
FIG. 1A is a plan view of an ammunition link belt without ammunition rounds therein, which belt is typical of the belts which may be utilized in conjunction with the present invention.
Figure 1B:
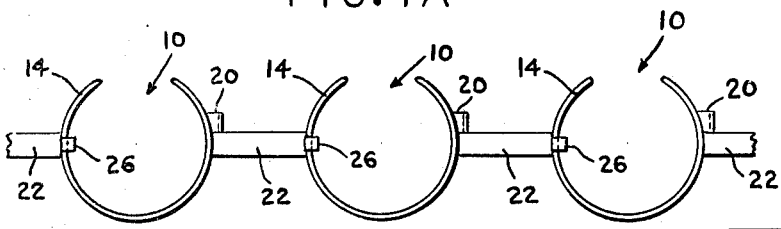
FIG. 1B is a front elevational view of the belt shown in FIG. 1A.

Referring, therefore, to FIGS. 1A and 1B, there are shown a plurality of such links designated generally by the reference numeral 10. Links 10 are transversely spaced such as to receive ammunition, however, the ammunition is not shown. In this regard, the longitudinal center line of the position of the ammunition to be received within cooperating links 10 is designated by reference numeral 12.

Each link 10 includes a first generally C-shaped band 14, a second generally C-shaped band 16 and a third generally C-shaped band 18. First and second C-shaped bands 14 and 16 are coaxial and define, effectively, a cylindrical container within which to receive a round of ammunition along longitudinal center line 12. Thus, center line 12 of a round of ammunition corresponds to the geometric center of bands 14 and 16.

Third generally C-shaped band 18 is transversely spaced from first and second bands 14, 16 and positioned such as to be longitudinally coaxial with the center line axis 12 of the first and second bands 14, 16 of the next adjacent ammunition link 10. Thus, upon the insertion of a round of ammunition through bands 14 and 16 of one link 10 and 18 of the next adjacent link, the round of ammunition effectively becomes a pintle of a hinge defined by adjacent belt links. So long as the ammunition round is in the position within the three bands, 14, 16, and 18, adjacent links are held much as the leaves of the hinge. Upon removal of the ammunition rounds, the adjacent links are free to move independently and thus may come apart.

Bands 14 and 16 of each link 10 are connected by a longitudinal extending connector strip 20. Similarly, band 18 is connected to bands 14 and 16 on each link 10 through connector strips 21 and 22.

Rigidly secured to first band 14, or integral therewith, is an ammunition retention tab 24. Tab 24 is secured to band 14 at a position generally diametrically opposite to that of the connecting joint of strips 20 and 22. Formed on the end of tab 24 is a generally V-shaped detent element 26. As will be recognized by those skilled in these arts, detent 26 is provided to resiliently engage an annular channel 30 which is formed at the base of a round of ammunition 32. The cooperation of detent 26 with channel 30 serves to position and retain round 32 within the ammunition link during assembly and handling.

Figure 2:
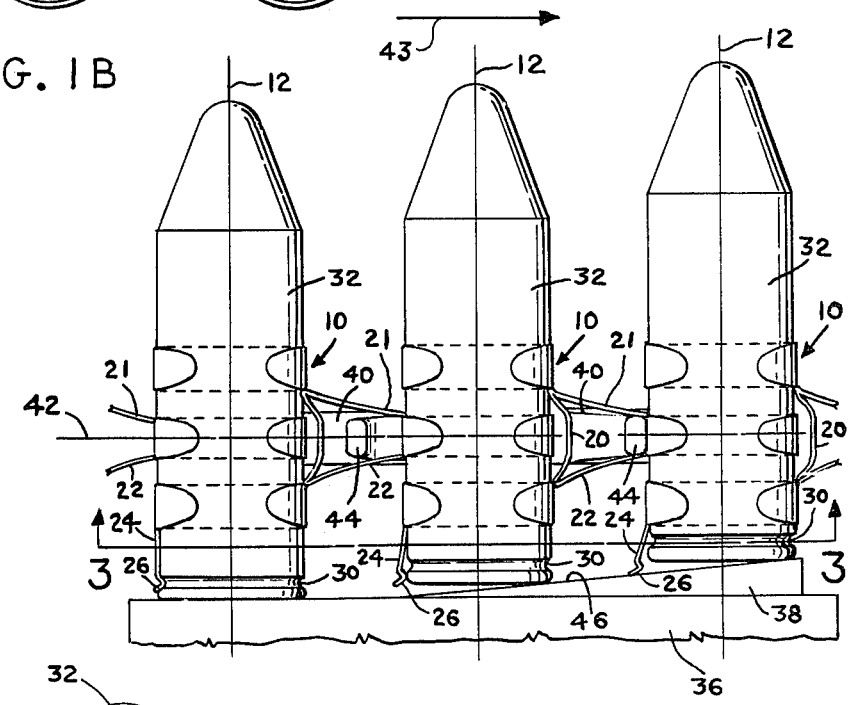
FIG. 2 is a view similar to FIG. 1A but showing the rounds positioned in the belt and showing the prestripping operation of the cam apparatus according to the invention.
Figure 3:
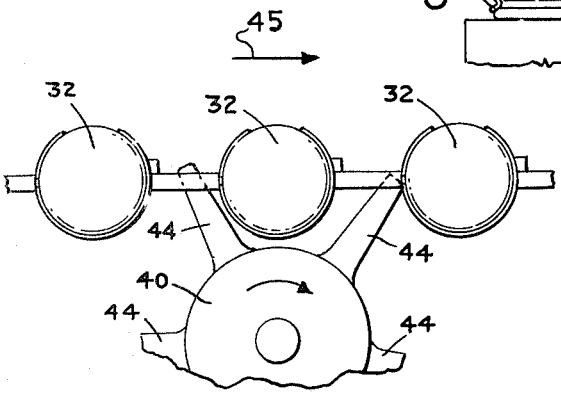
FIG. 3 is a cross-sectional elevational view through the plane 3,3 of FIG. 2.

Referring now to FIGS. 2 and 3, there is shown a portion of an ammunition belt being advanced into firing position of a weapon during which advancement the prestripping according to the present invention occurs. Thus, in FIG. 2 a portion of a support means 36 of an automatic weapon is shown to act as a base for a camming element 38.

The ammunition belt is being advanced toward firing position by the rotation of a sprocket 40 which is driven by the feed mechanism of the weapon in a manner well-known to those skilled in these arts. Advancement of the ammunition belt comprising the links 10 is along a transverse axis 42 in the direction of arrow 43 shown in FIG. 2. Retention of the links in alignment along axis 42 is achieved by the cooperation of sprocket teeth 44 of sprocket wheel 40 with the individual links 10. More particularly, as the sprocket wheel 40 rotates, the sprocket teeth 44 are caused to be received within the openings defined by connector strips 20, 21, and 22 as well as by the C-shaped band 18 of the ammunition links 10. As sprocket wheel 40 rotates in the clockwise direction as shown in FIG. 3, the ammunition belt is caused to be displaced in the direction of arrow 45 and adjacent sprocket teeth 44 engage the openings of the respective ammunition links sequentially whereby the cause advancement of the ammunition belt and therewith the rounds into firing position.

It should also be noted that the engagement of sprocket teeth 44 within the openings defined by the respective ammunition links 10 preclude displacement of the links in the direction of the longitudinal axis 12 of the rounds.

As best may be seen in FIG. 2, the respective rounds 32 are advanced together with the ammunition belt in the direction of arrow 43 by the rotation of sprocket 40. As the respective rounds are displaced from left to right, their lower surfaces come into engagement with the surface 46 of camming element 38 causing the round to be displaced along axis 12 and within the ammunition links 10. More specifically, the action of the sprocket 40 retains the ammunition links against displacement with respect to axis 12 while the action of cam surface 46 against the lower surface of rounds 32 causes displacement of the rounds upwardly as seen in FIG. 2.

Displacement of the rounds by the camming action of surface 46 causes displacement of retention tab 24 and therewith detent 26 out of channel 30 thus effectively releasing the rounds from the retaining means of the ammunition link. The force required to displace the round from the retaining means is a force which otherwise would have to have come from the drive spring of the operating mechanism and as such the drive spring of the operating mechanism is relieved from the load presented by the displacement of the detent element from the annular channel and also from the initial displacement of the round within the ammunition links 10. Accordingly, as will be recognized by those skilled in these arts, the apparatus according to the invention provide for reduction of the load handled by the drive spring of the operating mechanism thus achieving the object of the invention by therewith increasing the life of the drive spring and other parts and the efficiency of the weapon.

Cam element 38 may be secured to the weapon in a conventional manner, e.g. machine screws or otherwise and each of the respective elements of the invention may be made from conventional materials in a conventional manner all well-known to those skilled in these arts.

It further will be recognized that many modifications and variations can be made to the disclosed embodiment of the invention without departing from its spirit and scope.

The invention in its broader aspects is not limited to the specific combinations, improvements, and instrumentalities described but departures may be made therefrom within the scope of the accompanying claims without departing from the principles of the invention and without sacrificing its chief advantages.

What is claimed is:

1. Apparatus for prestripping rounds of ammunition from an ammunition belt comprising a plurality of cooperating links used in conjunction with a gas operated automatic weapon, wherein energy created by the expanding gases is used to cause an operating group to recoil from the battery position, during which recoil stroke the automatic feed mechanism of the weapon advances the ammunition belt to place the next round in position for displacement into the firing chamber by the operating group and the operating group compresses a drive spring, which expands during the counter recoil stroke and moves said operating group forward to engage the base of said round to remove the round from said link and into the firing chamber, and wherein each of said links includes a detent means for engaging an annular channel in said round for positioning and retaining said round, comprising:

advancing means driven by the operation of said automatic weapon for advancing said ammunition belt along a transverse axis, and cam means disposed on said weapon, said cam means having a fixed surface extending in the direction of said transverse axis and positioned such as to directly contact the base of said round and cause partial displacement of said round longitudinally within said links sufficient only to disengage said detent means from said channel during said recoil stroke, so that during the counter recoil stroke the operating group engages the base of said round and removes the round from said link and into said chamber.

2. Apparatus according to claim 1 wherein said advancing means includes means for restraining said links from movement in said longitudinal direction of said displacement of said rounds.

3. Apparatus according to claim 2 wherein said advancing means comprises a rotating sprocket having sprocket teeth thereon wherein said sprocket teeth are receivable within openings formed in said links to advance said ammunition belt and to restrain said links from said longitudinal movement.

* * * * *